US006645128B1

(12) United States Patent
Hur

(10) Patent No.: US 6,645,128 B1
(45) Date of Patent: Nov. 11, 2003

(54) EXERCISE BELT

(76) Inventor: Kyung Man Hur, 11 Tamarack Rd., Wayne, NJ (US) 07470

( * ) Notice: Subject to any disclaimer, the term of this patent is extended or adjusted under 35 U.S.C. 154(b) by 0 days.

(21) Appl. No.: 10/330,216

(22) Filed: Dec. 30, 2002

(51) Int. Cl.[7] ..... A63B 21/02

(52) U.S. Cl. ..... 482/124; 601/69; 601/70; 601/71; 601/132; 601/143; 601/147; 482/105; 482/124; 482/121; 482/148

(58) Field of Search ..... 601/69, 70, 71, 601/132, 124, 143, 147; 482/105, 124, 121, 148

(56) References Cited

U.S. PATENT DOCUMENTS 2,035,010 A * 3/1936 Rawlings
2,574,945 A * 11/1951 Werner
2,688,460 A * 9/1954 Fischer et al.
2,742,036 A * 4/1956 Montesano
6,026,531 A * 2/2000 Pruitt
6,350,249 B1 * 2/2002 Zicherman

* cited by examiner

*Primary Examiner*—Jerome W. Donnelly
(74) *Attorney, Agent, or Firm*—Birch, Stewart, Kolasch & Birch, LLP

(57) ABSTRACT

An exercise belt which includes resilient connectors which connect a back panel with overlapping front panels, said overlapping front panels containing compressible hemispherical protruding elements which apply localized pressure to the abdomen of the user.

12 Claims, 2 Drawing Sheets

EXERCISE BELT

BACKGROUND OF THE INVENTION

1. Field of Invention

The present invention relates to an improved exercise belt and more particularly, to a belt to be worn encircling the waist of the user, including a back panel, two front panels that overlay over the abdomen, and resilient connectors between the ends of the back panel and the front panels, whereby the compressible hemispherical protruding elements at the inside front of the belt apply localized pressure to the abdomen of the user.

2. Description of Related

Various types of exercise belts are known in the art. Generally, conventional exercise belts comprise a plurality of prongs with sponge-like inside surfaces, a plurality of springs containing movable balls, massaging elements, a plurality of rubber balls, resiliently expansible sections, a plurality of rollers and/or a plurality of protruding elements disposed thereon, respectively, For example, U.S. Pat. No. 3,637,207 to Christensen, Jr. discloses a belt having prongs extending inwardly through a layer of sponge-like compressible material fastened to the inside surface of the belt. The length of the prongs and the thickness of the layer are about the same, so that when the belt presses tightly against the wearer, the sharpened tips of the prongs will stick into the flesh of the wearer. With the prongs and the layer positioned to overlie the wearer's abdomen, the wearer will be encouraged to contract the abdominal muscles, thereby reducing the pressure of the belt against the wearer and minimizing the irritation produced when the prongs stick into the wearer's flesh.

U.S. Pat. No. 3,659,843 to Kojigian, Jr. discloses a belt including a back panel, side panels and overlapping front panel sections provided with Velcro fasteners. Tubular pockets in the side panels each contain a helical spring. A steel ball is freely movable within each spring. The movements of the wearer of the belt will cause movement of the balls between the ends of the springs, and the resulting vibrations will produce stimulation of the wearer's muscles.

U.S. Pat. No. 3,727,608 to Simsian discloses an exercising apparatus fitted with a belt for applying massage stimulation to the user's midsection during exercise. As shown in FIG. 7, the belt carries a group of massaging elements in the form of hollow compressible rubber bulbs. An air vent in each of the massaging elements allows air to fill and exhaust from the elements as they expand and contract. Other forms of the massaging elements are shown in FIGS. 8–13.

U.S. Pat. No. 1,257,957 to Kost discloses an appliance including a cradle supporting an array of soft rubber balls mounted for rotation on vertical spindles in the cradle. The balls engage and massage the abdomen of the user of the appliance, while the user is in a stretched upright posture.

U.S. Pat. No. 1,324,043 to Greene, U.S. Pat. No. 1,382,700 to Whalen, and U.S. Pat. No. 2,220,593 to Watson disclose belts including a resiliently expansible section employing helical tension springs, respectively U.S. Pat. No. 3,957,039 to Ehren discloses a body massager which is formed by a loop of an elastic rod-like material carrying spaced rollers that impart a massaging stimulation to the user. The use of the massager about the midsection of the user is illustrated in FIGS. 3 and 4. The rollers may be formed of yieldable material.

U.S. Design Pat. No. Des. 324,422 to Powell discloses a belt appearing to have an array of protruding elements carried on the inside surface of the belt and hook-and-loop elements at ends of the belt.

However, such conventional exercise belts suffer from a number of problems, including the fact that they do not apply localized pressure to the abdomen of the wearer.

SUMMARY OF THE INVENTION

Accordingly, it is an object of the present invention to provide an exercise belt which eliminates the above problems encountered with conventional exercise belts.

Another object of the present invention is to provide an improved exercise belt including at least one compressible protruding element provided at the inside front of the belt for applying localized pressure to the abdomen of the wearer.

A further object of the present invention is to provide a belt which encircles the waist of the user, including a back panel, two front panels that overlap over the abdomen, and resilient connectors provided between the ends of the back panel and the front panels wherein the resilient connectors, in the form of helical tension springs, overlie pads that contact the sides of the user's waist. On the inner surface of the inner one of the front panels are provided a plurality, e.g. three, hemispherical protrusions of spongy resilient material. The protruding elements contact the abdomen of the user and provide stimulation to the abdominal muscles as the user moves, while also performing an exercise function. Hook-and-loop fastener found between confronting surfaces of the overlapping front panels allows the size of the belt to be adjusted to accommodate different users.

Still another object of the present invention is to provide an exercise belt which is simple in structure, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
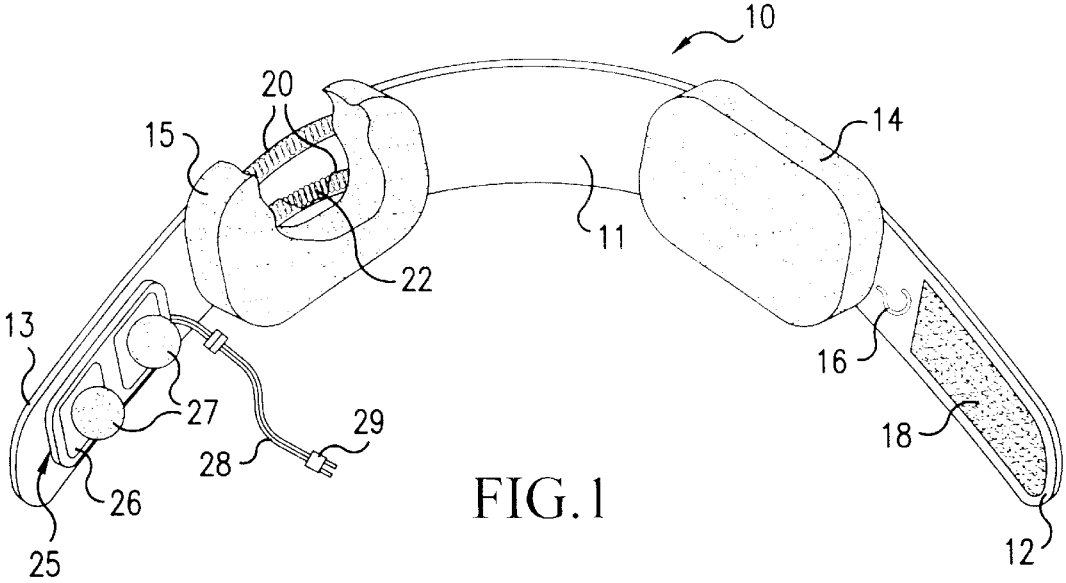
FIG. 1 is a perspective view of an exercise belt according to the present invention.

Referring now in detail to the drawings for the purpose of illustrating preferred embodiments of the present invention, the exercise device as shown in FIGS. 1, 2, 3 and 4, comprises an exercise belt 10 to be worn encircling the waist of the wearer 35 which includes a back panel 11, and a first front panel 12 and a second front panel 13 that overlap the abdomen 36 of the wearer 35, and resilient connectors such as a first pair of springs 21 and a second pair of springs 22 which extend between the ends of the back panel 11 and the front panels 12 and 13.

Figure 6A:
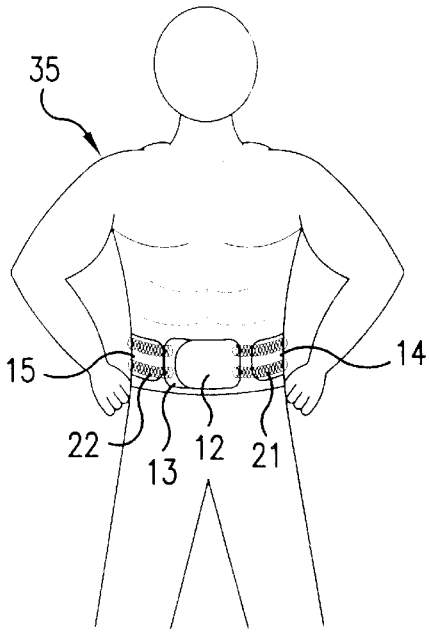
FIG. 6A is a view illustrating the exercise belt according to the present invention, as worn by the wearer.
Figure 6B:
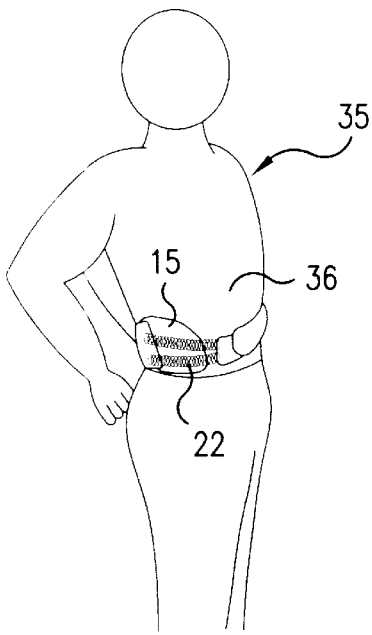
FIG. 6B is a side view illustrating the exercise belt according to the present invention as worn by the wearer.
Figure 2:
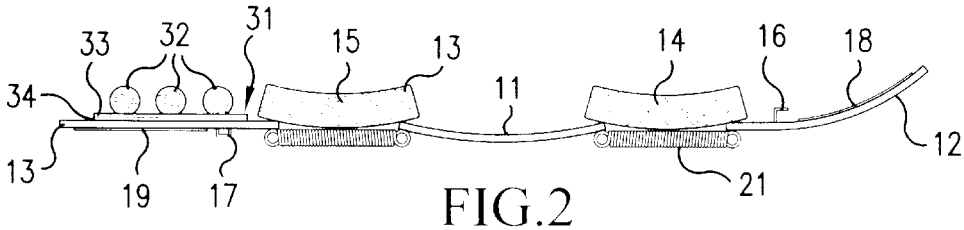
FIG. 2 is a side view of the exercise belt according to the present invention.
Figure 4:
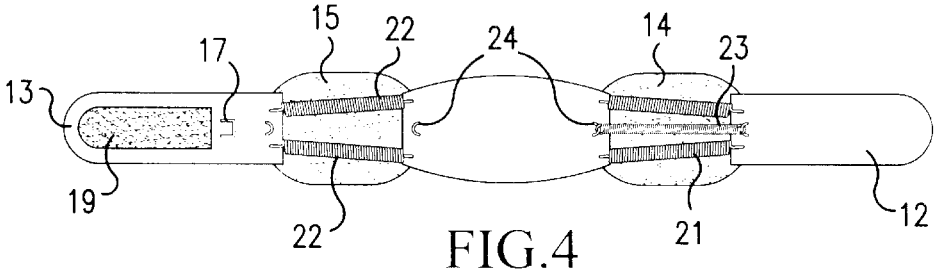
FIG. 4 is a bottom view of the exercise belt according to the present invention.

As shown in FIGS. 2 and 4, the resilient connectors, in form of helical tension springs 21 and 22, overlie pads such as a first sponge 14 and a second sponge 15 that contact the sides of the wearer's waist (FIGS. 6A and 6B). Advantageously, the first and second springs 21 and 22 are disposed within spring tubes 20, respectively. The spring tubes 20 are made of a plastic material in order to maintain a proper contour (FIG. 1), while performing an exercise.

Referring in detail to FIGS. 1, 2, 3 and 4, the exercise belt 10 includes a first Velcro type tape 18 disposed on the inside surface of the first front panel 12 and a second Velcro type tape 19 disposed on the outside surface of the second front panel 13, which may allow the size of the exercise belt 10 to be adjusted to accommodate different sizes of wearers.

Also, the exercise belt 10 further includes a hook 16 and a loop 17 which hook together to accommodate different users.

Figure 5A:
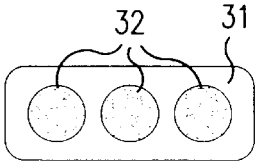
FIG. 5A is a top view of an attachable sponge massage member of the exercise belt according to the present invention.
Figure 5B:
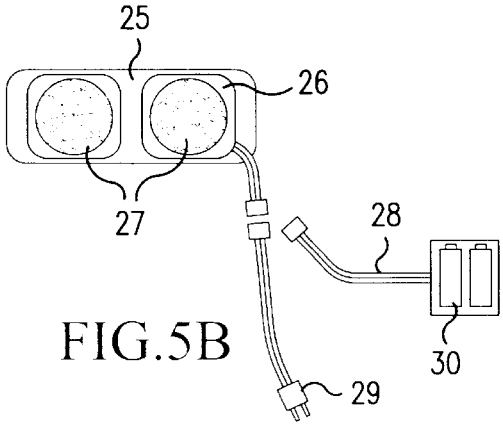
FIG. 5B is a top view of an attachable electric massage member of the exercise belt according to the present invention.

As shown in FIG. 1 and FIG. 5B, two hemispherical protrusions 27 are disposed in the ball vibration pocket 26 of an electric massage member 25 disposed on the inner surface of the second front panel 13. The electric massage member 25 can be connected to an electrical source, for example, a battery 30 through an electric wire 28 and a plug 29. The electrical massage member 25 has a first massage Velcro type tape 33 disposed on the bottom thereof for fastening to a second massage Velcro type tape 34 disposed on the inside of the second front panel 13. When the exercise belt 10 is not being used, the electric massage member 25 can be readily removed from the second front panel 13 by separating the first and second massage Velcro type tapes 33 and 34 by simple manual movement. The hemispherical protrusions 27 are resilient massage balls which are made of sponge material.

Figure 3:
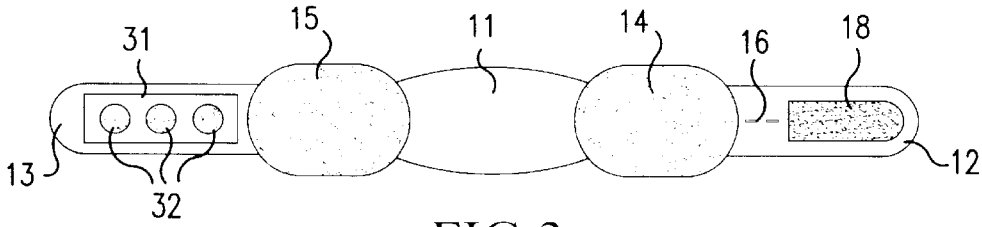
FIG. 3 is a top view of the exercise belt according to the present invention.

Referring in detail to FIGS. 2, 3 and 5A, on the inner surface of the second front panel 13 are three hemispherical protrusions 32, i.e., sponge balls which define the sponge massage member 31. The sponge massage member 31 has the first massage Velcro type tape 33 disposed on the bottom thereof for fastening to or separating from the send massage Velcro type tape 34. A plurality of the protruding balls, e.g., two or three, protruding balls 27 and 32 are positioned to contact the abdomen 36 of the wearer 35 and provide stimulation to the abdominal muscles as the wearer 35 moves, while exercising.

Also, the exercise belt 10 according to the present invention further includes an auxiliary spring 23 disposed in parallel within the pair of springs 21 as shown in FIG. 3. The auxiliary spring 23 is fixed to both spring attachments 24.

Accordingly, when the exercise belt 10 is worn while performing various exercises, the muscles of the abdomen and back are stimulated and massaged by the springs 22 and 23 through the sponges 14 and 15, and the hemispherical protrusions 27 and 32 of spongy resilient material thereby applying localized pressure to selective parts of the body, particularly the abdomen.

The invention being thus described, it will be obvious that the same may be varied in many ways. Such variations are not to be regarded as a departure from the spirit and scope of the invention, and all such modifications as would be obvious to one skilled in the art are intended to be included in the scope of the claims.

What is claimed is:

1. An exercise belt for encircling the waist of the wearer which comprises:

a back panel;

first and second front panels adapted to overlap with each other;

resilient connectors connecting the back panel with each of the first and second front panels, said resilient connectors provided with a cushion-type material; and a detachable massage member disposed on the inner surface of either of the first or second front panel, whereby, while the wearer performs an exercise, the cushioned resilient connectors and the detachable massage member cooperate to stimulate and massage the abdomen of the wearer.

2. The exercise belt of claim 1, wherein said first and second front panels includes a Velcro type tape disposed on inner and outer side surfaces thereof for fastening the panels together in an overlapping manner.

3. The exercise belt of claim 1, wherein said resilient connectors are a plurality of helical tension springs.

4. The exercise belt of claim 3, wherein the resilient connectors comprise two helical tension springs.

5. The exercise belt of claim 4, wherein the resilient connectors comprise three helical tension springs.

6. The exercise belt of claim 1, wherein said detachable massage member comprises a plurality of compressible balls which protrude from the first or second front panel and means are provided for vibrating said balls.

7. The exercise belt of claim 6, wherein the balls are made of a spongy resilient material.

8. The exercise belt of claim 7, containing two protruding balls.

9. The exercise belt of claim 8, containing three balls.

10. The exercise belt of claim 1, wherein said detachable massage member comprises a plurality of compressible balls which protrude from the first or second front panel toward the abdomen of the wearer.

11. The exercise belt of claim 1, which further includes hook-and-loop fasteners for accommodating different size users.

12. The exercise belt of claim 3, wherein said helical tension springs are enclosed within a tube-type material.

* * * * *